US006328385B1

(12) United States Patent
Lau

(10) Patent No.: US 6,328,385 B1
(45) Date of Patent: Dec. 11, 2001

(54) INFLATABLE CHAIR

(75) Inventor: Kwok-Wing Lau, Sheung Shui (HK)

(73) Assignee: Pleasure Time Products (HK) Limited (HK)

( * ) Notice: Subject to any disclaimer, the term of this patent is extended or adjusted under 35 U.S.C. 154(b) by 0 days.

(21) Appl. No.: 09/511,177

(22) Filed: Feb. 22, 2000

(51) Int. Cl.[7] ..... A47C 7/02

(52) U.S. Cl. ..... 297/452.41; 297/DIG. 3; 5/655.3

(58) Field of Search ..... 297/452.41, DIG. 3; 5/655, 655.3

(56) References Cited

U.S. PATENT DOCUMENTS

| | | | | |
|---|---|---|---|---|
| 2,691,179 | * | 10/1954 | Kann | 297/DIG. 3 X |
| 3,029,109 | * | 4/1962 | Nail | 297/DIG. 3 X |
| 3,204,678 | * | 9/1965 | Worcester | 5/655.3 X |
| 3,283,343 | * | 11/1966 | Worcester | 5/655.3 X |
| 4,040,655 | * | 8/1977 | Garrick et al. | 297/DIG. 3 X |
| 4,108,492 | * | 8/1978 | Kirby | 297/DIG. 3 X |
| 4,547,919 | * | 10/1985 | Wang | 297/DIG. 3 X |
| 5,333,336 | * | 8/1994 | Langsam | 297/DIG. 3 X |
| 5,947,563 | * | 9/1999 | Klimenko | 297/452.41 |
| 5,951,111 | * | 9/1999 | Klimenko | 297/452.41 |
| 6,131,219 | * | 10/2000 | Roberts | 5/655.3 X |
| 6,135,551 | * | 10/2000 | Linder | 297/452.41 X |
| 6,152,530 | * | 11/2000 | Hsu et al. | 297/452.41 X |
| 6,161,902 | * | 12/2000 | Lieberman | 297/452.41 |
| 6,179,383 | * | 1/2001 | Ochi | 297/452.41 X |

FOREIGN PATENT DOCUMENTS

| | | | | |
|---|---|---|---|---|
| 330566 | * | 6/1930 | (GB) | 5/655.3 |

* cited by examiner

*Primary Examiner*—Peter M. Cuomo
*Assistant Examiner*—Rodney B. White
(74) *Attorney, Agent, or Firm*—Raymond Sun

(57) ABSTRACT

An inflatable chair has an outer chamber that defines the shape and size of the chair, and at least one support section positioned inside the outer chamber. The support section(s) provide the desired support at particular locations of the outer chamber so as to provide the necessary comfort and stability to the chair.

10 Claims, 3 Drawing Sheets

INFLATABLE CHAIR

BACKGROUND OF THE INVENTION

1. Field of the Invention

The present invention relates to inflatable furniture, and in particular, to an inflatable chair.

2. Description of the Prior Art

There is presently a wide variety of indoor and outdoor furniture. One common type of furniture is inflatable. Inflatable furniture is usually provided in the form of an enclosed vinyl or plastic chamber into which air can be introduced to inflate the chamber. The chamber is usually formed to assume a predetermined shape and size when completely inflated. Inflatable furniture provides an important benefit of being easily portable, since the inflatable furniture can be deflated to be conveniently moved to different locations, where it can be inflated again for use.

Unfortunately, the currently-available inflatable furniture suffer from several important drawbacks. First, most of these inflatable furniture are not comfortable since the inflatable nature of the pre-configured chamber contributes to a softness or lumpiness that makes the user feel like he or she is sitting on a balloon. Second, the stability of inflatable furniture is also questionable. For example, an inflatable sofa or chair rocks around when a user moves or fidgets in the seat. Again, this lack of stability is due to the inflatable nature of the pre-configured chamber. This lack of stability further contributes to the lack of comfort for the user.

Thus, there remains a need for an inflatable chair that is both comfortable, yet provides good stability.

SUMMARY OF THE DISCLOSURE

The objectives of the present invention are accomplished by providing an inflatable chair that has an outer chamber that defines the shape and size of the chair, and at least one support section positioned inside the outer chamber. The support section(s) provide the desired support at particular locations of the outer chamber so as to provide the necessary comfort and stability to the chair.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides an inflatable chair that provides improved stability and comfort for the user. The inflatable chair of the present invention provides a plurality of inflatable supports that are positioned inside the outer chamber at selected locations to optimize support and comfort.

Figure 1:
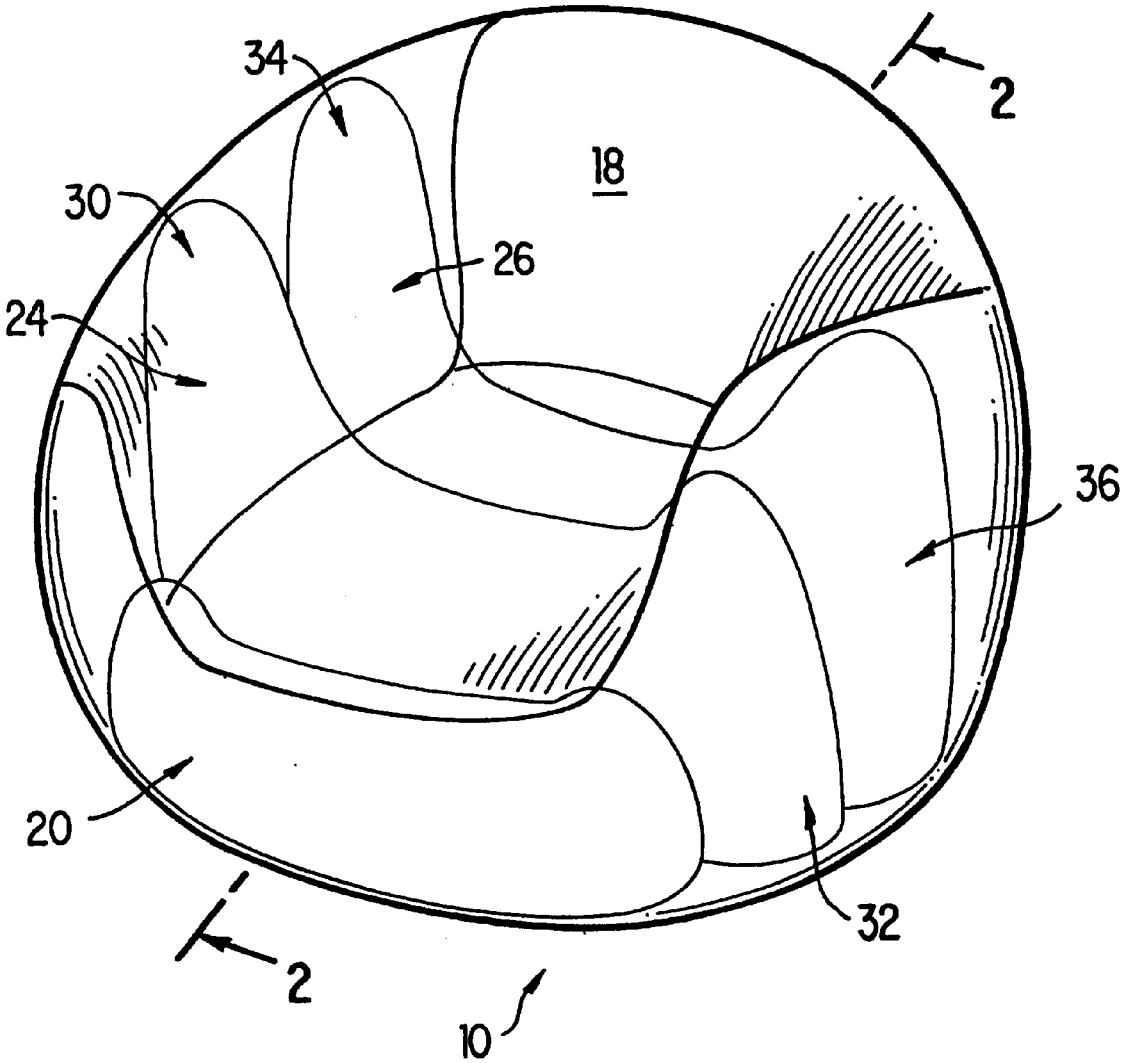
FIG. 1 is a front perspective view of an inflatable chair according to one embodiment of the present invention.
Figure 2:
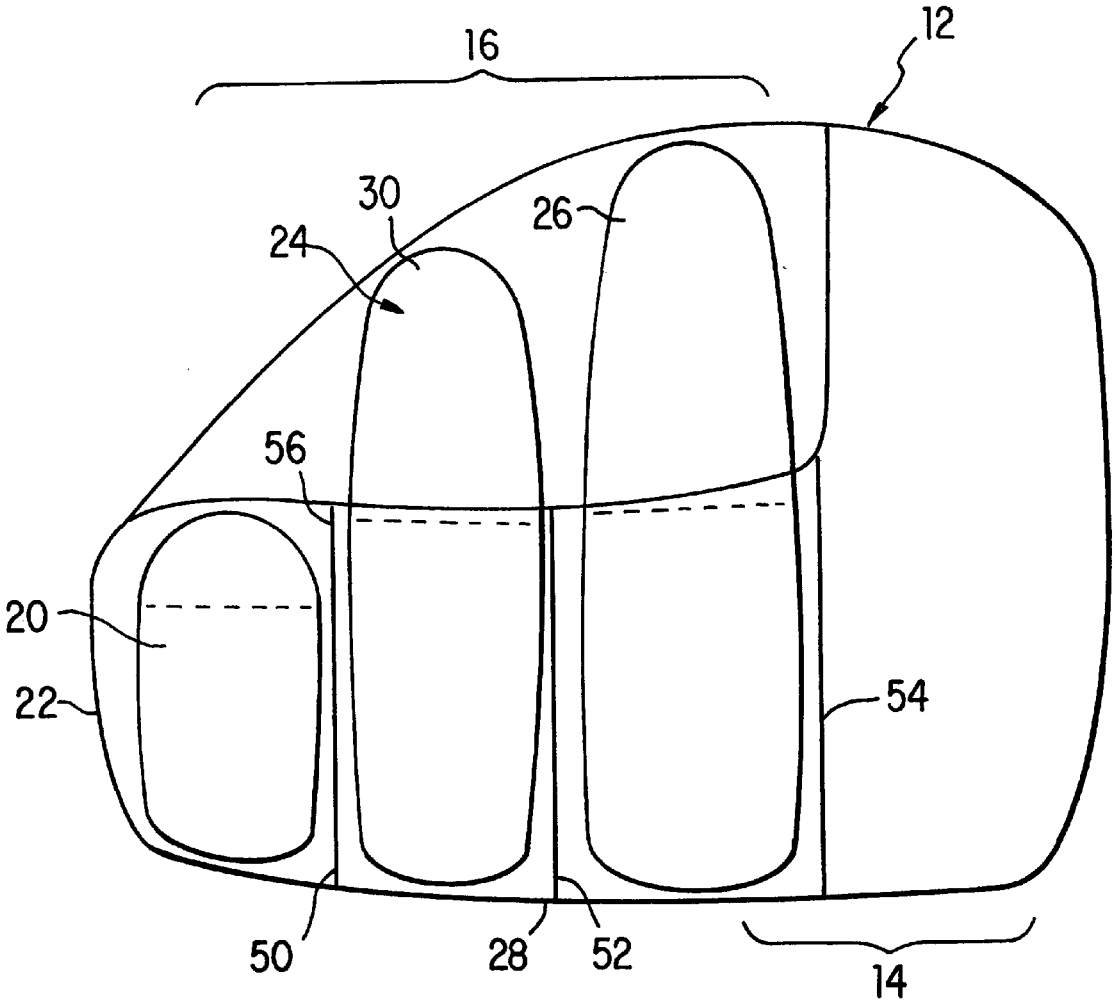
FIG. 2 is a cross-sectional view of the chair of FIG. 1 taken along line 2—2 thereof.

An inflatable chair 10 according to the present invention is illustrated in connection with FIGS. 1 and 2. The inflatable chair 10 has an outer or main chamber 12 that defines the shape and size of the chair 10. Specifically, the outer chamber 12 is formed with a predetermined size and shape that would define the desired chair when it is completely inflated for use. As shown in FIGS. 1 and 2, this predetermined shape can have a back or rest portion 14 that includes a rear vertical section 18 that serves as a back rest. This predetermined shape can also have a generally concave front or seat portion 16. The outer chamber 12 can be made of any air-tight material that holds air, including vinyl, laminated vinyl, and polyethylene. The material of the outer chamber 12 can be colored or transparent.

The chair 10 also includes a plurality of support sections that are secured to the interior of the chamber 12. A first support section 20 is provided adjacent the front edge 22 of the seat portion 16, a second support section 24 is provided adjacent and behind the first support section 20, and a third support section 26 is provided adjacent and behind the second support section 24 Each support section 20, 24, 26 is secured to the base 28 of the chamber 12 (e.g., by welding, and in the embodiment of FIGS. 1–3, can also be positioned in the seat portion 16. The first support section 20 is the smallest and is adapted to support the user's thighs when seated in the chair 10. The second support section 24 is adapted to support the user's thighs and buttocks, and has two vertically extending arm sections 30 and 32 that are adapted to support the user's arms when seated in the chair 10. The third support section 26 is adapted to support the user's lower back, and has two vertically extending arm sections 34 and 36 that are adapted to support the user's shoulders when seated in the chair 10. The third support section 26 also provides sufficient rear support to prevent the chair 10 from tipping rearwardly if the user leans backward when seated.

Figure 3:
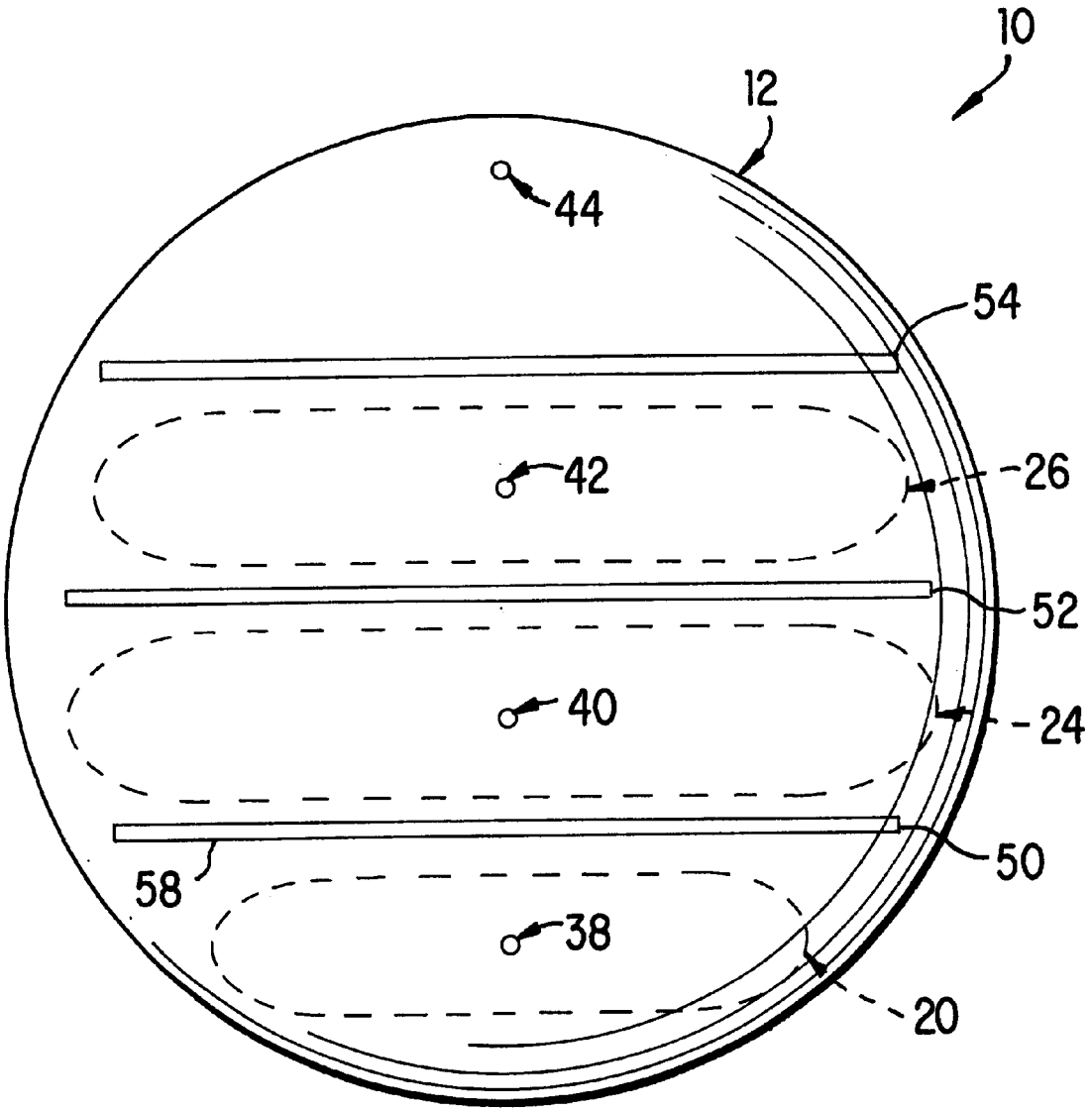
FIG. 3 is a bottom plan view of the chair of FIG. 1.

Each support section 20, 24, 26 can be made the same material as the chamber 12. Referring to FIG. 3, four separate valves 38, 40, 42 and 44 are provided in the base 28 of the chamber 12 for allowing the introduction of air into the support sections 20, 24, 26 and the chamber 12, respectively, to inflate each of these support sections 20, 24, 26 and chamber 12. Each valve 38, 40, 42, 44 can be embodied in the form of any conventional valve that is used for inflatable objects.

As shown in FIGS. 2 and 3, three restricting beams 50, 52, 54 are spaced apart inside the outer chamber 12 to help the outer chamber 12 attain the predetermined shape of the chair 10. A first beam 50 is provided between the support sections 20 and 24, a second beam 52 is provided between the support sections 24 and 26, and a third beam 54 is provided behind the third support section 26. Each beam 50, 52, 54 can be made from the same material as the chamber 12, and has a top end 56 that is attached (e.g., by welding) to the top of the chamber 12, and a bottom end 58 that is attached (e.g., by welding) to the bottom of the chamber 12. Each beam 50, 52, 54 has a predetermined height that operates to define the height of the chamber 12 at certain locations so as to form the desired shape of the chair 10. In other words, it is the attachment of the top end 56 and the bottom end 58 of each beam 50, 52, 54 to opposing inner surfaces of the chamber 12 that restrict expansion of the chamber 12 beyond the pre-defined heights of the respective beams 50, 52, 54 at the respective locations of these beams 50, 52, 54. For example, the first beam 50 has a predetermined height that prevents the front portion of the chamber 12 from inflating beyond a desired height.

Collectively, the support sections 20, 24 and 26 provide the necessary stability and comfort to the chair 10. First, the support sections 20, 24 and 26 are positioned in selected locations inside the chamber 12 to provide the necessary support and comfort at the desired positions. For example, the first support section 20 is positioned to support the thighs, the second support section 24 is positioned to support the thighs and buttocks, and the third support section 26 is positioned to support the lower back. By positioning the support sections 20, 24, 26 at these positions, the support sections 20, 24, 26 operate to prevent the seat defined by the chamber 12 from sagging when a user is seated on it, thereby providing firm support and comfort. This overcomes one of the most serious drawbacks of conventional inflatable chairs, since a user who sits only on the outer chamber 12 (without any internal support sections) would find that the entire chair will sag downwardly towards the user's center of gravity.

Second, the support sections 20, 24, 26 provide distributed support to prevent the chair 10 from tipping over. For example, the third support section 26 provides sufficient rear support to prevent the chair 10 from tipping rearwardly if the user leans backward when seated. The arm sections 30, 32, 34, 36 provide sufficient side support to prevent the chair 10 from tipping to either side if the user leans to either side when seated.

Although the present invention illustrates the use of three separate support sections 20, 24, 26, it is possible to use any number of support sections inside the chamber 12 to accomplish the same objectives. However, there is a balance between the appropriate number of support sections provided and the nature and extent of the support and comfort desired. For example, providing a larger number of separate support sections may allow the designer to better distribute the support and balance that is desired. Providing only one support section, for example, for the entire chair 10 may provide some degree of comfort and support, but not the same degree of comfort and support experienced by the three support sections 20, 24, 26. Similarly, providing too many separate support sections can be undesirable since it will increase costs and inconvenience to the user, since the user will need to invest a lot of time to inflate each separate support section.

For example, it is possible to provide an additional support section at the back portion 16, although this is not illustrated in FIGS. 1–3 because the specific configuration for the chair 10 renders such a support section unnecessary.

To use the chair, the user inflates the support sections 20, 24, 26 and the chamber 12 by introducing air through the valves 38, 40, 42 and 44, respectively. Therefore, the support sections 20, 24, 26 and the chamber 12 each defines a separate chamber. To store the chair, the user merely deflates each support section 20, 24, 26 and the chamber 12, and folds up the chamber 12 for storage.

Thus, the inflatable chair 10 according to the present invention is very easy and convenient to use, and utilizes its support sections 20, 24, 26 to provide balanced and distributed support and comfort throughout the chair.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An inflatable chair, comprising:

an outer chamber that defines the shape and size of the chair, the outer chamber having an interior;

a support section positioned in the interior of the outer chamber, wherein the support section is a first support section;

a second support section positioned in the interior of the outer chamber behind the first support section;

a third support section positioned in the interior of the outer chamber behind the second support section; and wherein the third support-section has two vertical arm sections.

2. The chair of claim 1, wherein the outer chamber defines a seat portion and a back portion, with the first support section provided in the seat portion.

3. The chair of claim 1, wherein the second support section has two vertical arm sections.

4. The chair of claim 1, wherein the outer chamber defines a seat portion and a back portion, with the first, second and third support sections provided in the seat portion.

5. The chair of claim 1, wherein the outer chamber has a base, and the first support section is attached to the base.

6. The chair of claim 5, further including a first valve provided in the base for introducing air to the outer chamber, and a second valve provided in the base for introducing air to the support section.

7. The chair of claim 1, wherein the outer chamber is made from an air-tight material.

8. An inflatable chair, comprising:

an outer chamber that defines the shape and size of the chair, the outer chamber having an interior;

a plurality of support sections positioned in the interior of the outer chamber, wherein the plurality of support sections includes:

a first support section;

a second support section positioned behind the first support chamber; and a third support section positioned behind the second support chamber; wherein the third support section has two vertical arm sections.

9. The chair of claim 8, wherein the second support section has two vertical arm sections.

10. The chair of claim 8, wherein the outer chamber defines a seat portion and a back portion, with the plurality of support sections provided in the seat portion.

* * * * *